US005163201A

United States Patent [19]

Raasch et al.

[11] Patent Number: 5,163,201

[45] Date of Patent: Nov. 17, 1992

[54] METHOD AND APPARATUS FOR CLEANING THE MEASURING CHAMBER OF A SCANNER HEAD OF A YARN MONITOR

[75] Inventors: Hans Raasch, Mönchengladbach; Wilhelm Oehrl, Erkelenz, both of Fed. Rep. of Germany

[73] Assignee: W. Schlafhorst Ag & Co., Mönchengladbach, Fed. Rep. of Germany

[21] Appl. No.: 643,563

[22] Filed: Jan. 18, 1991

[30] Foreign Application Priority Data

Jan. 18, 1990 [DE] Fed. Rep. of Germany ..... 4001255

[51] Int. Cl.[5] ..... B08B 1/04

[52] U.S. Cl. ..... 15/304; 15/312.1; 15/345

[58] Field of Search ..... 15/312.1, 301, 304, 15/345

[56] References Cited

U.S. PATENT DOCUMENTS

| | | | |
|---|---|---|---|
| 3,638,275 | 2/1972 | Larson et al. | 15/304 |
| 4,028,136 | 6/1977 | Kamp | 15/312.1 X |
| 4,125,991 | 11/1978 | Stahlecker | 15/304 X |
| 4,542,620 | 9/1985 | Kase et al. | 15/304 X |
| 4,864,679 | 9/1989 | Briner | 15/312.2 |

FOREIGN PATENT DOCUMENTS 2658441 6/1978 Fed. Rep. of Germany .

*Primary Examiner*—Chris K. Moore

*Attorney, Agent, or Firm*—Herbert L. Lerner; Laurence A. Greenberg

[57] ABSTRACT

A method for cleaning the measuring chamber of a contactlessly operating scanner head of an apparatus for monitoring yarns on a textile machine includes bringing a cleaning tool formed of an elastic material from a waiting position into an operating position. The cleaning tool is mechanically brought to walls of the measuring chamber for a cleaning operation. The elastic material cleaning tool is adapted to the contour of the measuring chamber during the cleaning operation by positioning the cleaning tool. The measuring chamber is mechanically cleaned without yarn being disposed in the measuring chamber. The cleaning tool is taken out of operation and returned to the waiting position after the cleaning operation. An apparatus for cleaning the measuring chamber includes a mechanically operating cleaning tool being formed of an elastic material and having a contour. The cleaning tool is brought from a waiting position into an operating position in the measuring chamber for performing a cleaning operation while adapting the contour of the elastic material cleaning tool approximately to the contour of the measuring chamber.

14 Claims, 3 Drawing Sheets

METHOD AND APPARATUS FOR CLEANING THE MEASURING CHAMBER OF A SCANNER HEAD OF A YARN MONITOR

The invention relates to a method and apparatus for cleaning the measuring chamber of a contactlessly operating scanner head of an apparatus for monitoring yarns on a textile machine.

Yarn monitors that monitor the quality of the yarn are used especially with yarns that are spun from individual fibers, for instance on rotary spinning machines, air spinning machines or friction spinning machines, and for rewinding such yarns on bobbin winding machines. These yarn monitors are used to check whether or not the yarn has the required thickness and mass and therefore the necessary number of fibers in its cross section. Inductive, capacitive and optical measuring methods exist. In all cases, the yarn passes through the measuring chamber of the scanner head of the yarn monitor after being produced or upon rewinding, and is scanned there in a contactless manner.

Both spinning and yarn rewinding produce considerable quantities of dust and other dirt, which also settles in the measuring chamber of a scanner head. Sticky brightening and softening finishes, in particular, can soil the measuring chamber. The soiling distorts the measured values to an increasing extent, causing the wrong conclusions to be drawn as to the quality of the yarns. If the measuring chambers of the scanner heads are not cleaned regularly, the soiling unavoidably results in some lengths of yarn that by themselves are the cause of measurement errors. As a rule, the yarn monitors are connected to a yarn cutter, which cuts the yarn when a flaw occurs that is beyond tolerable limits. For this reason, the yarn monitors are also known simply as "cleaners", even though they themselves do not perform a cleaning function. In order to prevent soiling of a "cleaner" from causing incorrect conclusions as to the yarn quality, the cleaner itself must accordingly be cleaned from time to time.

One known possibility for cleaning the measuring chamber of a scanner head is to aim a stream of air into the measuring chamber, in order to blow the contaminants out. German Published, Prosecuted Application DE-AS 21 45 732, for instance, discloses an apparatus for keeping the measuring chamber of a contactless scanner head for a traveling yarn in a clean condition. In order to keep the contactless scanner head clean in an electronic yarn monitor, a blowing method is used in which the freely moving fibers entrained by the traveling yarn and by the boundary layer flow forming about it, are compelled to change direction, or else the fluff sticking to the solid surfaces is separated from them. To this end, the outlet opening of an air supply line is disposed directly upstream of or in the measuring chamber, in such a way that the air stream extends perpendicularly or virtually perpendicularly relative to the travel direction of the yarn.

Such blowing methods can blow away dust that rests loosely on the surface, but contaminants that stick firmly, such as electrostatically charged dust or sticky finishes, cannot be blown away by an air stream.

It is accordingly an object of the invention to provide a method and apparatus for cleaning the measuring chamber of a scanner head of a yarn monitor, which overcome the hereinafore-mentioned disadvantages of the heretofore-known methods and devices of this general type and which enable effective elimination of even stubborn soiling in the measuring chamber, such as electrostatically charged dust or sticky finishes.

With the foregoing and other objects in view there is provided, in accordance with the invention, a method for cleaning the measuring chamber of a contactlessly operating scanner head of an apparatus for monitoring yarns on a textile machine, which comprises bringing a cleaning tool formed of an elastic material from a waiting position into an operating position; mechanically bringing the cleaning tool to walls of the measuring chamber for a cleaning operation or action; adapting the elastic material cleaning tool to the contour of the measuring chamber during the cleaning operation by positioning the cleaning tool; mechanically cleaning the measuring chamber without yarn being disposed in the measuring chamber; and taking the cleaning tool out of operation and returning the cleaning tool to the waiting position after the cleaning operation.

As compared with the known cleaning method using blown air, the method of the invention for mechanical cleaning of the measuring chamber with a cleaning tool has the advantage of being able to remove even sticky residues from the yarn, such as finishes or electrostatically charged dust, from the measuring chamber.

In order to enable thorough cleaning of the measuring chamber to take place, every surface of the measuring chamber must be reached by the cleaning tool. To this end, the cleaning tool advantageously is formed of an elastic material. Examples of elastic material are bristles, strips of fabric and small sponges. An elastic material adapts to the contour of the measuring chamber and as a result all of the surfaces of the measuring chamber can be reached.

In accordance with another mode of the invention, there is provided a method which comprises brushing out the measuring chamber. The advantage of using bristles as the cleaning tool is that they are elastic and that because of their elasticity they can adapt to the contour of the measuring chamber. On the other hand, they are rigid enough to be capable of mechanically removing the dirt. The mechanical cleaning action of bristles is substantially more effective than blowing the dirt off solely with air.

In accordance with a further mode of the invention, there is provided a method which comprises reinforcing the mechanical cleaning of a cleaning tool with a stream of blown air. The particles of dirt scraped away from the walls of the measuring chamber are blown out of the measuring chamber and also out of the cleaning tool. This lessens the danger that the cleaning tool itself will become plugged with dirt, thereby reducing its cleaning action.

In accordance with an added mode of the invention, there is provided a method which comprises removing the dirt produced in the cleaning process by suction, i.e., vacuum cleaning. This kind of suction advantageously prevents the dirt leaving the measuring chamber, for instance fibers and finishes, from settling on other parts of the machine. If the dirt produced during the cleaning of the measuring chamber were not immediately removed, the soiling problem would simply be shifted elsewhere. Moreover, when the dirt is removed by vacuum cleaning, the cleaning action of the cleaning tool is reinforced, and the tool also undergoes a certain cleaning as well.

In accordance with an additional mode of the invention, there is provided a method which comprises reinforcing the mechanical cleaning operation with both blown air and the removal of dirt by suction. When cleaning with blown air, the danger exists that particles of dirt will be blown uncontrollably onto other parts of the machinery. With the prevailing negative pressure of the dirt removal by suction, this is prevented, since the dirt particles are aspirated and received by the suction device.

Cleaning of the measuring chamber can be performed only when there is no yarn in it. The yarn travel is interrupted whenever the yarn has been broken because of a cleaning cut, in response to a signal of the scanner head, if the yarn has been torn, if a change of takeup bobbin is performed, or in the case of bobbin winding machines when a new bobbin is furnished.

Therefore, in accordance with yet another mode of the invention, there is provided a method which comprises cleaning the measuring chamber whenever the yarn travel is interrupted and before the yarn travel is re-established. For instance, the cleaning tool can be introduced into the measuring chamber by a servicing apparatus that simultaneously re-establishes yarn travel. In spinning machines, this may be a piecing carriage while in bobbin winding machines it may be a service carriage having a yarn joining device, such as a splicer. However, the cleaning apparatus may also be provided at each work station. This is advantageous, for instance, in bobbin winding machines that are already equipped with their own splicer and therefore no longer require any service carriage. In that case, the cleaning apparatus should, for instance, be provided at each winding station. Each time the yarn travel is interrupted, it can be pivoted into the measuring chamber of the scanner head by its own pivoting apparatus. Alternatively, cleaning of the measuring chamber may be initiated on the basis of some other criterion. A calibration of the measuring head is effected each time there is no yarn laid in it. In this process, a check is made as to whether the measured value deviates from a predetermined measured value. The predetermined measured value or reference value is ascertained with a completely clean measuring head. As the time in operation lengthens and the soiling increases, the measured value deviates from the predetermined reference value. When the reference value is found to have been exceeded, on the occasion of a monitoring measurement, the cleaning apparatus can be ordered to clean the measuring chamber. In that case, the cleaning is always performed as a function of the degree to which the measuring chamber is soiled. The advantage of this variant method is that the cleaning is only performed whenever it is actually necessary. Therefore, in accordance with yet a further mode of the invention, there is provided a method which comprises cleaning the measuring chamber when a measured value determined in a monitoring measurement, without a yarn in the measuring chamber, deviates from a predetermined reference value.

In accordance with yet an added mode of the invention, as another option for controlling the cleaning method of the invention, there is provided a method which comprises performing the cleaning of the measuring chamber in accordance with a predeterminable timing program. In that case, the cleaning is performed after a predetermined period of time, regardless of the actual extent of soiling of the measuring chamber. Subsequently, on the basis of a time interval that is set once and for all, the cleaning can be repeated continuously after a predetermined period of time, under the control of a timer clock. In that case, however, it is necessary to interrupt the yarn travel for the sake of cleaning.

Yet another possibility is to assign the cleaning to a mobile service unit which, for instance, drives along the textile machine and performs certain servicing tasks, such as rotor cleaning and piecing in the case of spinning machines. The cleaning of the rotor can advantageously be coupled with a simultaneous cleaning of the measuring chamber of a measuring head.

In accordance with yet an additional mode of the invention, there is provided a method which comprises predetermining the duration of cleaning of the measuring chamber. This can be performed, for instance, through an adjustable time switch clock. If the cleaning apparatus is mechanically actuated, it can be performed by means of the way in which actuating cam disks are constructed. The cleaning duration can therefore be advantageously adapted to the extent of soiling that is present.

In accordance with again another mode of the invention, there is provided a method which comprises performing a monitoring measurement and determining a measured value without a yarn in place after each cleaning of a measuring chamber; comparing the measured value with a predetermined reference value; and performing at least one of a repetition of the cleaning and an issuance of an error signal if the measured value deviates from the reference value.

Repeating the cleaning means that a further attempt is made to free the measuring chamber of dirt. If the cleaning is thus repeated, this may mean that the dirt is so firmly stuck in the measuring chamber that it can no longer be removed or it may mean that the cleaning tool, for instance the brush, is so plugged with dirt that it has to be changed or cleaned. It is advantageous if an error signal is issued in the event that the cleaning is repeated. The worker operating the machinery can learn from the error signal that problems have arisen when cleaning a measuring chamber and can intervene to overcome them. Alternatively, instead of repeating the cleaning, an error signal can also be issued directly. With the objects of the invention in view there is also provided, in a textile machine including an apparatus for monitoring yarn having a contactlessly operating scanner head with a measuring chamber having a contour, an apparatus for cleaning the measuring chamber, comprising a mechanically operating cleaning tool being formed of an elastic material and having a contour; and means for bringing the cleaning tool from a waiting position into an operating position in the measuring chamber for performing a cleaning operation while adapting the contour of the elastic material cleaning tool approximately to the contour of the measuring chamber.

In accordance with another feature of the invention, the cleaning tool is a rotatable brush.

In accordance with a further feature of the invention, the cleaning tool is a pivotable brush segment.

In accordance with an added feature of the invention, there is provided a blower nozzle and/or a suction apparatus disposed in the vicinity of the cleaning tool for removing dirt by vacuum cleaning.

In accordance with an additional feature of the invention, the cleaning tool bringing means brings the blower nozzle and/or the suction apparatus into the operating position along with the cleaning tool.

In accordance with a concomitant feature of the invention, the textile machine has work stations, a service unit, and means for moving the service unit and selectively positioning the service unit at every work station to perform servicing tasks, at least the cleaning tool being carried by the service unit.

Other features which are considered as characteristic for the invention are set forth in the appended claims.

Although the invention is illustrated and described herein as embodied in a method and apparatus for cleaning the measuring chamber of a scanner head of a yarn monitor, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments in which the cleaning of measuring chambers of the scanner heads according to the invention will be described in further detail, when read in connection with the accompanying drawings.

Figure 1:
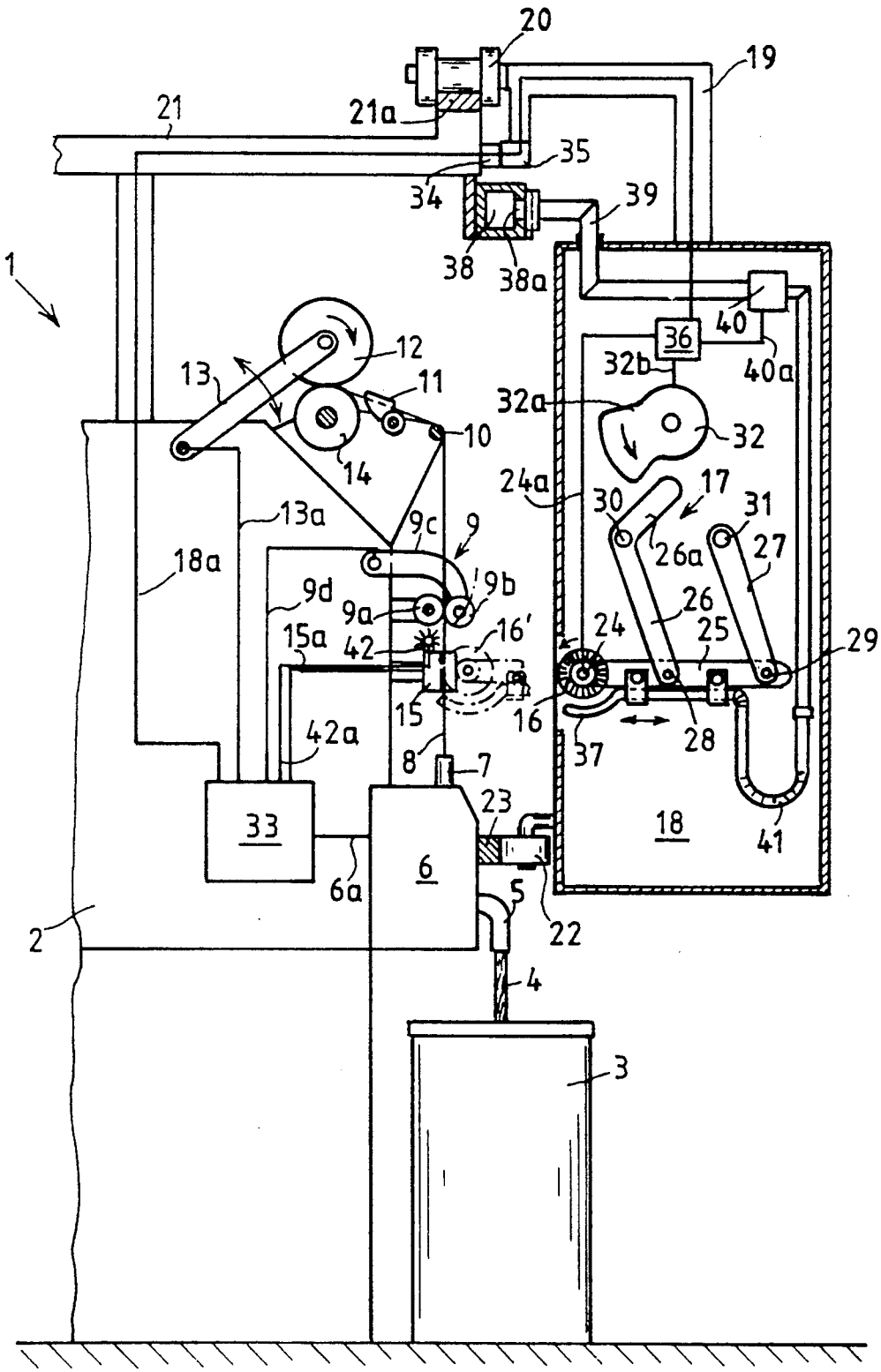
FIG. 1 is a fragmentary, diagrammatic, partly sectional, side-elevational view of spinning machine, in which a cleaning apparatus is carried by a mobile service apparatus.

Referring now to the figures of the drawing in detail and first, particularly, to FIG. 1 thereof, there is seen a spinning machine 1. Only those parts of the spinning machine that are necessary for explanation and comprehension of the invention are shown.

A spinning station 2 of the spinning machine 1 is shown, along with its most important apparatus characteristics. A can 3 from which sliver 4 is drawn into a spinning unit 6 through an inlet 5, stands in front of the spinning station. The spinning unit may be a rotor spinning apparatus or a friction spinning apparatus. A yarn or thread 8 is drawn off from a yarn outlet tube 7 by means of yarn delivery rollers 9, which include a delivery roller **9*b* being pressed against a fixed delivery roller 9*a* by means of a pivot lever 9*c*. The yarn 8 is released by pivoting of the level 9*c* back again. The yarn travels over a yarn deflector rod 10 to the yarn guide 11 and is wound onto a takeup bobbin 12. The takeup bobbin 12 is held by a bobbin holder 13 and rests on a winding roller 14**, which drives it in the direction shown by an arrow.

Figure 2:
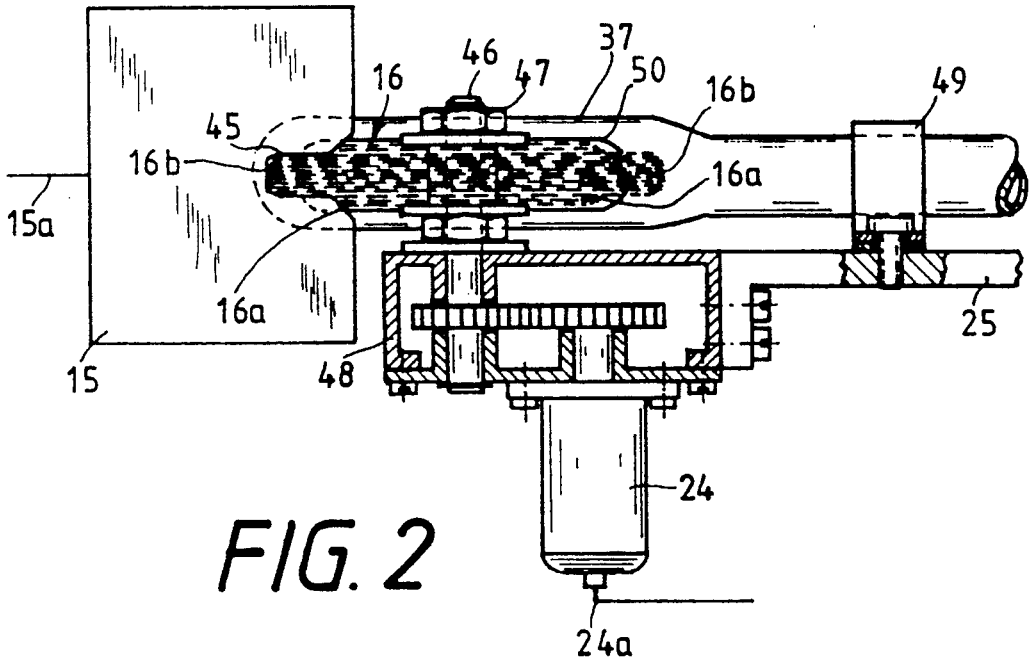
FIG. 2 is an enlarged, fragmentary, partly sectional, top-plan view of a rotating brush that cleans the measuring chamber.

A scanner or measuring head 15 of a monitoring device for the yarn 8 is disposed above the spinning unit 6. The yarn 8 is scanned in contactless fashion in the scanner head 15. This scanning may be performed capacitively or optically. Measuring heads and associated measuring methods are known from the prior art and need not be described in detail herein. As a rule, these measuring heads have a slit-shaped measuring chamber through which the yarn travels, as seen in FIG. 2. As the yarn travels through the narrow, gap-shaped measuring chamber, there is the danger that loose fibers, stirred-up dust and entrained brightening and softening finishes will settle on the surfaces of the measuring chamber. These deposits, which can be exacerbated by electrostatic forces inside the measuring chamber, distort the outcome of measurement over the course of time, leading to an incorrect evaluation of the quality and quantity of the yarn traveling through the chamber. In order to prevent distortion of the outcome of measurements from such deposits, it is proposed in accordance with the invention that the measuring chamber be mechanically cleaned. In the present exemplary embodiment, a rotatable brush 16 is provided for this purpose. This rotatable brush is a wheel which is equipped with bristles on the periphery thereof that protrude radially. The rotatable brush 16 is part of a cleaning apparatus 17 that is installed on a mobile service configuration 18. This service configuration is not shown in further detail herein but it may, for instance, serve to carry out piecing in the event of yarn breakage. The service configuration 1 can also carry cleaning devices for cleaning the spinning unit, such as a rotor in the case of rotor spinning machines. The service configuration 18 is suspended from a support arm 19, which has a drive roller 20 on an end thereof that rolls along a rail **21*a* extending along the spinning machine. An extension arm or boom 21 carries the rail 21*a* above the spinning stations. Support wheels 22, only one of which is shown herein, support the service configuration 18 on rails 23** that extend at the level of the spinning unit.

The cleaning apparatus 17 of the present exemplary embodiment has the following structure:

The rotatable brush 16 is driven by a motor 24. The motor and brush are seated at the front end of an approximately horizontally extending extension arm or boom 25. The extension arm 25 is suspended from parallel steering arms or connecting rods 26 and 27 and is joined to them at respective joints 28 and 29. The parallel steering arms are connected to the service unit 18 at respective joints 30 and 31. The parallel steering arm 26 has an extension **26*a* extending beyond the joint 30. This extension 26*a* is operatively connected with a cam disk 32. The cam disk 32 is part of a package of cam disks which is not shown in further detail herein, having respective cams that actuate features of the service unit 18 at certain times. These features are not shown in detail here, but are known from the prior art. In order to initiate the process of cleaning the measuring chamber, the extension 26*a* of the parallel steering arm 26 is actuated by a cam 32*a* of the cam disk 32. If the cam disk 32 is rotating in the direction of the arrow, the cam 32*a* presses down the extension 26*a*. The cleaning tool, that is the rotatable brush 16, is thus moved to a working position 16'**.

The cleaning method according to the invention will now be described in further detail in terms of the present exemplary embodiment:

The scanner head 15 can simultaneously be used as a yarn monitor. If the yarn 8 is no longer present, either because it has broken or, for instance, because the takeup bobbin 12 has taken up the necessary quantity of yarn and is being changed, the absence of the yarn is recorded by the scanner head 15 and reported to a control unit 33 over a signal line **15*a*. The control unit 33 may be provided locally at every spinning station, or centrally for the entire spinning machine. The control unit 33 thereupon stops the spinning unit 6 by signalling over a signal line 6***a*, and causes the yarn delivery roller 9*b* to lift away from the yarn delivery roller 9*a* by signalling over a signal line 9*d*. At the same time, a command for pivoting the bobbin holder 13 upward is issued over a signal line 13*a*, and the bobbin holder thus lifts the takeup bobbin 12 away from the winding roller 14. The service unit 18 is requested over a signal line 18*a*. The signal line 18*a* extends through the extension arm 21 to a contact rail 34, which extends parallel to the rail 21*a* of the service unit 18. A sliding contact 35 that is in contact with the contact rail 34, is located on the support arm 19 of the service unit 18 and connects the signal line 18*a* to a control unit 36 of the service unit 18 through the support arm. Other ways of achieving signal transmission are naturally also possible and are not precluded in this exemplary embodiment.

Once the service unit 18 has positioned itself in front of the spinning station in response to the signal of the control unit 33, it can perform other service tasks besides taking care of the yarn breakage or piecing the yarn over again. Such tasks may, for instance, be the performance of cleaning work at the spinning unit 6, such as the cleaning of a rotor, in the case of a rotor spinning machine. The measuring chamber of the scanner head 15 can also be cleaned with the cleaning apparatus 17. To this end, the control unit 35 issues a signal to the cam disk 32 over a signal line 32*b*, in order to cause the cam disk 32 to rotate in the direction of the arrow. The cam 32*a* thereupon presses down the extension 26*a* of the parallel steering arm 26. The cleaning tool is then moved to the scanner head from its waiting position shown in the drawing. The extension arm 25 is pivoted to the left in the direction of the arrow, and the rotatable brush 16 is moved into the working position 16'. The cam 32*a* of the cam disk 32 is shaped in such a way that the motion of the extension arm 25 comes to a stop once the rotatable brush 16 is in its working position 16', in other words once it has been introduced all the way into the measuring chamber of the scanner head 15. At the same time, the motor 24 is switched on over a signal line 24*a*, in order to drive the rotatable brush 16. The brush 16 then rotates in the direction of the arrow.

In order to prevent the dirt brushed out of the measuring chamber from getting into the spinning unit 6, a suction apparatus 37 is provided. The suction apparatus 37 includes a tube that extends underneath the rotatable brush and has either one large suction opening or a plurality of small ones, oriented toward the brush. This suction apparatus 37 is connected to the central negative pressure supply of the spinning machine. This negative pressure supply is symbolized by a suction conduit 38 that extends below the rail 21*a*. A suction tube 39 of the service unit 18 is connected to this suction conduit 38. The suction conduit 38 has a connection opening 38*a* at the level of each spinning station, which is self-closable by a non-illustrated device. Such devices are known in the prior art. The suction tube 39 adjoins this connection opening and is at negative pressure whenever a valve 40 in the suction tube 39 is opened by the control unit 36 over a signal line 40*a*. The valve 40 is opened whenever the rotatable brush 16 of the cleaning apparatus 17 is moved into the working position 16'. The suction apparatus 37 communicates with the suction tube 39 through a flexible hose 41, in order to enable it to move along with the extension arm 25.

Once the rotatable brush 16 has been moved to its working position 16', it rotates within the slit-like measuring chamber of the scanner head 15. Since the cleaning tool is formed of an elastic material, it can easily adapt to the contour of the measuring chamber. The brush can also be given a shape that is approximately equivalent to that of the measuring chamber. This makes it even easier for the brush to adapt to the contour of the measuring chamber.

The bristles of the brush exert a scouring action on the dirt sticking to the walls of the measuring chamber. Even sticky finishes and statically charged dust are effectively removed as a result. The cleaning action of the brush is reinforced by the suction of the suction apparatus 37. The dirt produced during the cleaning of the measuring chamber is removed by suction and thus cannot soil the other parts of the machine, in particular the spinning unit 6. The suction also exerts a cleaning action on the bristles underneath the rotating brush 16. If there is sufficiently strong suction, even the bristles are thus cleaned.

Both the brush and the brush holder are constructed in such a way that the brush is interchangeable. Once the soiling of the brush exceeds tolerable limits, it must be changed. The cleaning action of the brush can be checked both by the naked eye and by self-monitoring on the part of the measuring head. If the predetermined reference value for a clean measuring head without a yarn placed therein is no longer matched after the measuring head has been cleaned, then it must be assumed that the cleaning action of the brush is unsatisfactory. In that case, the brush must be replaced.

The cleaning time can be predetermined by both the shape of the cam 32*a* of the cam disk 32 and the circumferential speed of the cam disk 32. As a result, the cleaning time can be adapted to the extent of soiling to be expected. The cleaning procedure is ended once the cam 32*a* again releases the extension 26*a* of the parallel steering arm 26. In that case, the extension arm 25 swings to the right in the direction of the arrow into its position of repose back inside the service unit 18, either by its own weight or by means of a non-illustrated spring. At the same time, the motor 24 of the rotating brush 16 is switched off by the control unit 36 over the signal line 24*a*. The valve 40 in the suction tube 36 then gives the command to return the cleaning tool to its 36 then gives the command to return the cleaning tool to its waiting position. This can be followed by a monitoring measurement in the measuring chamber without the yarn being in place. The measured value is compared with a predetermined measured value, which may be stored in memory in the control unit 33. If deviations occur, the cleaning can be repeated. At the same time, an error signal can be issued by the control unit 33. The error signal can be made visible by a signal light 42 on the scanner head 15, which is switched on over a signal line 42*a*. Instead of repeating the cleaning, merely the issuance of an error signal may also be provided. Once the cleaning has been completed, non-illustrated devices of the service unit can be given further commands that serve to re-piece the yarn and re-establish yarn travel. Once these tasks have been completed, the service unit 18 is ready for a request from some other spinning station.

FIG. 2 shows an enlarged portion of FIG. 1, with the rotating brush 16 having been moved to the working position, in the measuring chamber of the scanner head 15. Features that match the features of FIG. 1 are identified by the same reference numerals.

The scanner head 15 is merely shown in stylized form, since its structure is known from the prior art. The rotating brush 16 penetrates a gap-shaped measuring chamber 45 of the scanner head 15, when it is in its working position as shown. The brush 16 is interchangeably slipped onto a shaft 46 and is secured there by a nut 47. The shaft 46 protrudes from a gear 48 that is screwed onto the extension arm 25. The drive motor 24 of the brush 16 is flanged to the gear 48. As mentioned above, the suction apparatus 37 is disposed below the brush 16, which rotates in the direction of the arrow shown in FIG. 1. The tube of the suction apparatus 37 is adapted to the contour of the brush. The top of the tube facing the brush is open, resulting in an elongated slit 50. Suction is present at this slit 50. The suction aspirates the dirt that is brushed out of the measuring chamber 45, and removes it along with the dirt suspended among the bristles of the brush 16. The suction apparatus 37 in the present exemplary embodiment is secured to the extension arm 25 by straps or clips 49.

On order to provide easier placement of the yarn in the measuring chamber 45 of the measuring head 15, the slit-shaped measuring chamber 45 is widened into a V at its opening. The contour of the rotating brush 16 is approximately adapted to the contour of the measuring chamber. Reference numeral 16*a* represents a wider part of the brush, which cleans the wider, V-shaped opening in the measuring chamber. Reference numeral 16*b* represents a part of the brush that penetrates into the slit-shaped measuring chamber 45. Due to the resiliency of the bristles, the brush can adapt fully to the contour of the measuring chamber, even if the positioning of the cleaning apparatus with respect to the measuring chamber has not been carried out accurately.

Figure 3:
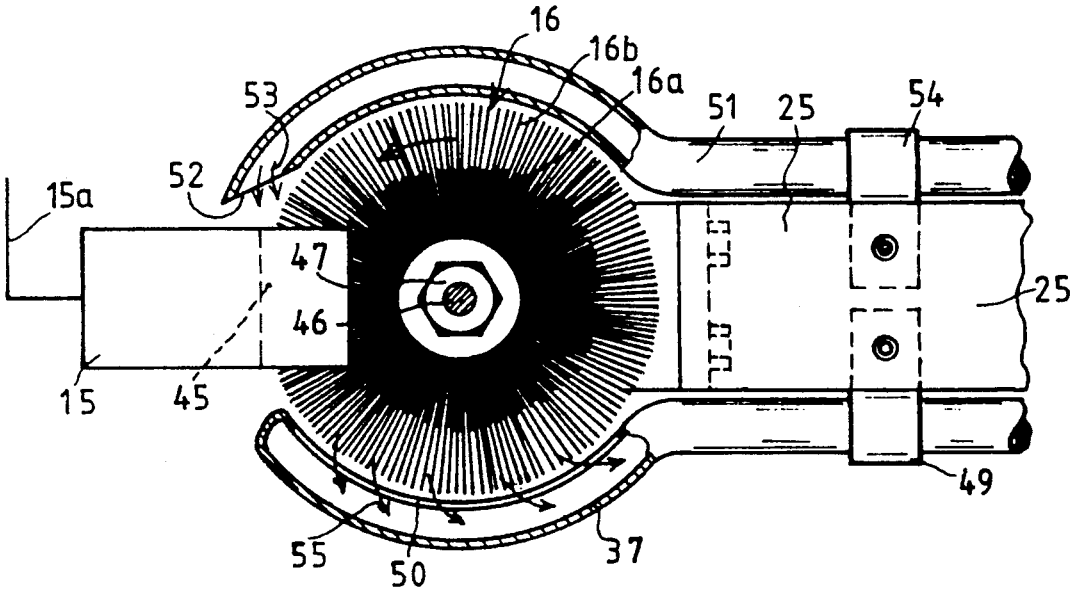
FIG. 3 is a fragmentary, partly sectional, side-elevational view of a rotating brush having a blower nozzle and a suction nozzle that cleans the measuring chamber.

FIG. 3 is a detailed side view of a rotating brush cleaning the measuring chamber of a scanner head. In the present exemplary embodiment, the motor and gear are disposed on the back of the brush and thus are covered by the brush. Features that match those of the preceding exemplary embodiments are identified by the same reference numerals.

As compared with the foregoing exemplary embodiments, this cleaning apparatus is additionally equipped with a lower line 51, which ends in a blower nozzle 52. In the present exemplary embodiment, the blower nozzle 52 is disposed in such a way that it blows air into the measuring chamber 45 from above, as viewed in the direction of rotation of the brush. The blower nozzle 52 of the blower line is shaped in such a way that the emerging blowing air, which is represented symbolically by arrows 53, reinforces the cleaning action of the bristles of the brush 16. The blower line 51 is secured to the extension arm 25 with straps or clips 54. The blower line 51 can be connected to a non-illustrated compressed air line of the textile machine on which the present cleaning apparatus is installed. For instance, compressed air is available on bobbin winder machines for the purpose of pneumatic splicing.

In the present exemplary embodiment, the brush 16 rotates in the direction of the arrow in the measuring chamber 45 of the measuring head 15. The dirt brushed off during the rotation of the brush is removed by vacuum cleaning by a stream of suction that is applied at the opening 50 in the suction apparatus 37 and is symbolically represented by arrows 55.

In the present exemplary embodiment, the brush 16 is again approximately adapted to the contour of the measuring chamber 45. The wider and therefore denser brush part 16*a*, which cleans the V-shaped yarn insertion opening of the measuring chamber, can be seen clearly. The brush part 16*b*, which cleans the slit-shaped measuring chamber 45, is narrower and not as dense.

Figure 4:
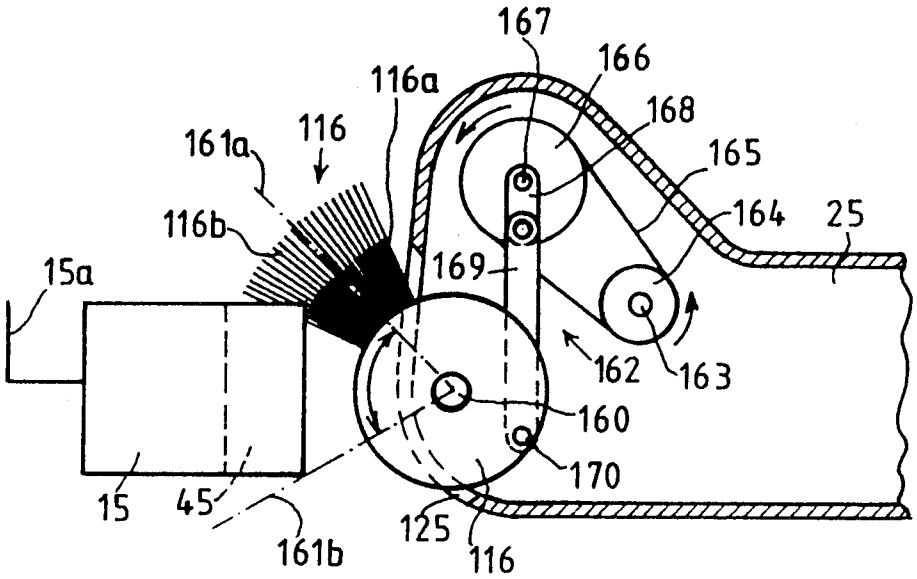
FIG. 4 is a fragmentary, partly sectional, side-elevational view of a pivotable brush segment that cleans the measuring chamber.

In FIG. 4, a further exemplary embodiment of a cleaning apparatus is shown. In this case, a pivotable brush segment is used as the cleaning tool, instead of a rotating brush. Instead of a rotational motion, the brush segment executes a pivoting motion, so that the bristles are moved back and forth in the measuring chamber.

Figure 5:
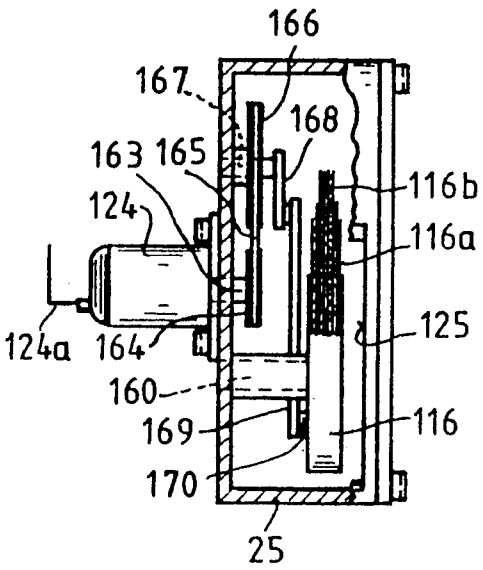
FIG. 5 is a fragmentary, partly sectional and partly broken-away, front-elevational view of the brush segment.

FIG. 5 is a front view showing the exemplary embodiment of FIG. 4, without the scanner head 15.

Both the disposition of the cleaning tool and its drive will now be described briefly. The extension arm 25 is constructed as a hollow carrier and has an opening 125 in the end surface thereof. A cleaning tool in the from of a brush segment 116 protrudes out of this opening 125. In the present exemplary embodiment, less than the entire end surface of a wheel is equipped with bristles. Instead, it is only equipped in this way within a segment of approximately 45°. The brush segment 116 has a structure comparable to that of the rotating brushes 16 of the previous exemplary embodiments. Bristles 116*b* extending into the slit-shaped measuring chamber 45 are narrower and longer than bristles 116*a* that clean the V-shaped insertion slit. The brush segment 116 pivots about a shaft 160 at an angle of approximately 90°, which is defined by center lines 161*a* and 161*b* of the brush segment and indicated by a double arrow inside the center lines 161*a* and 161*b*. The pivoting motion causes the brush segment 116 to be pivoted almost out of the measuring chamber each time, and during the back-and-forth motion it is pivoted all the way through the measuring chamber 45.

The pivoting motion of the brush segment 116 is generated by a crank drive 162. The drive is operated by a motor 124, which is laterally flanged to the extension arm 25 and is connected over a signal line 124*a* thereof to a non-illustrated control unit. A pulley 164 is seated on a shaft 163 of the motor 124. The pulley 164 rotates in the direction of the arrow and drives a pulley 166 through a belt 165. A rocker arm 168 is secured to a shaft 167 of the pulley 166. The rocker arm 168 engages a connecting rod 169, which in turn is rotatably supported on the periphery of the cleaning tool 116 by means of a tang 170. The rotational motion of the rocker arm 168 sets the connecting rod 169 into reciprocation, and this motion is transmitted to the tang 170. Upon a one-half rotation of the connecting rod 169, the tang 170 is raised counterclockwise in the direction of the pulley 166, from its lowest point to its highest point. The disk-shaped cleaning tool 116 is thus likewise rotated counter-clockwise. This rotation is effected over an angle of approximately 90°, as represented by the respective center lines 161*a* and 161*b* of the brush segment 116. During this motion, the brush segment 116 drops from its uppermost position shown in the drawing into the position represented by the center line 161*b*. Once the rocker arm 168 has passed top dead center and is moving downward again, the tang 170 is pushed downward as well, and the brush segment 116 lifts out of its position 161*b* back into its position 161*a*. Every single revolution of the pulley 166 and thus of the rocker arm 168 effects one back-and-forth motion of the brush segment 116.

FIG. 1 shows only one possibility for the way in which the cleaning tool can be moved to its working position. If no mobile service unit that can move past the work stations of the textile machine is provided, then the cleaning apparatus may be provided at every spinning or bobbin winding station.

It is possible to place the cleaning apparatus on a pivotable lever that is located below or above the scanner heads, depending on the space available. For cleaning purposes, this lever is then pivoted in such a way that the cleaning tool is placed in the measuring chamber. The cleaning tool may also be disposed on one of the pivotable suction nozzles, which in the case of bobbin winding machines, for instance, receive one of the yarn ends of the lower or upper yarn from one position and set it in place in a connecting device, for instance a splicer head. The only prerequisite in the disposition of the cleaning tool is that the suction nozzle for the upper or lower yarn be shaped in such a way that it can support the cleaning tool and that when it is in position the cleaning tool will indeed reach the inside of the measuring chamber. A suction apparatus that may be optionally provided for the dirt can be connected directly to the suction nozzle in this exemplary embodiment.

We claim:

1. In a textile machine including an apparatus for monitoring yarn having a contactlessly operating scanner head with a measuring chamber having a contour, an apparatus for cleaning the measuring chamber, comprising a mechanically operating cleaning tool being formed on an elastic material and having a contour; means for mounting said cleaning tool pivotably about a pivot axis; and means for bringing said mounting means from a waiting position to a location outside said measuring chamber wherein the pivot axis remains outside the measuring chamber and said cleaning tool extends at least partly inside the measuring chamber in an operating position for performing a cleaning operation.

2. The apparatus according to claim 1, wherein said cleaning tool is a rotatable brush.

3. The apparatus according to claim 1, wherein said cleaning tool is a pivotable brush segment.

4. The apparatus according to claim 1, including a blower nozzle disposed in the vicinity of said cleaning tool.

5. The apparatus according to claim 4, wherein said cleaning tool bringing means brings said blower nozzle into the operating position along with said cleaning tool.

6. The apparatus according to claim 1 including a suction apparatus disposed in the vicinity of said cleaning tool for removing dirt by vacuum cleaning.

7. The apparatus according to claim 6, wherein said cleaning tool bringing means brings said suction apparatus into the operating position along with said cleaning tool.

8. The apparatus according to claim 1, including a blower nozzle and a suction apparatus disposed in the vicinity of said cleaning tool for blowing dirt and removing dirt by vacuum cleaning.

9. The apparatus according to claim 8, wherein said cleaning tool bringing means brings at least one of said blower nozzle and said suction apparatus into the operating position along with said cleaning tool.

10. The apparatus according to claim 1, wherein the textile machine has work stations, a service unit, and means for moving said service unit and selectively positioning said service unit at every work station to perform servicing tasks, at least said cleaning tool being carried by said service unit.

11. The apparatus according to claim 1, wherein said contour of said cleaning tool is approximately adapted to the contour of the measuring chamber.

12. The apparatus according to claim 1, including means for determining the condition of the measuring chamber after a cleaning operation and for causing the cleaning operation to be repeated if the condition does not meet a predetermined condition.

13. The apparatus according to claim 1, including means for determining the condition of the measuring chamber after a cleaning operation and for issuing an error signal if the condition does not meet a predetermined condition.

14. The apparatus according to claim 1, wherein the measuring chamber is a slit-shaped measuring chamber extending in a direction parallel to a monitored yarn travel, said cleaning tool being a brush or brush segment with bristles, and said bristles extending into the measuring chamber substantially perpendicularly to the yarn travel direction.

* * * * *